United States Patent [19]

Hain

[11] Patent Number: 4,739,982

[45] Date of Patent: Apr. 26, 1988

[54] SHEET SEPARATING APPARATUS

[75] Inventor: David A. Hain, Dundee, Scotland

[73] Assignee: NCR Corporation, Dayton, Ohio

[21] Appl. No.: 905,083

[22] Filed: Sep. 8, 1986

[30] Foreign Application Priority Data

Apr. 25, 1986 [GB] United Kingdom ..... 8610222

[51] Int. Cl.[4] ..... B65H 3/10

[52] U.S. Cl. ..... 271/94; 271/99; 271/106; 271/108; 271/31.1

[58] Field of Search ..... 271/94–96, 271/105, 106, 108, 31.1, 11, 99

[56] References Cited

U.S. PATENT DOCUMENTS

| | | | |
|---|---|---|---|
| 2,770,458 | 11/1956 | Halahan et al. | 271/29 |
| 2,796,258 | 6/1957 | Beck | 271/96 |
| 2,817,519 | 12/1957 | Beck | 271/94 |
| 2,991,073 | 7/1961 | Relis | 271/105 X |
| 3,069,025 | 12/1962 | Winkler | 271/96 X |
| 3,086,771 | 4/1963 | Goin | 271/94 X |
| 3,271,024 | 9/1966 | May | 271/94 |
| 3,291,482 | 12/1966 | Stemmler | 271/11 |
| 3,796,426 | 3/1974 | Schilpf | 271/100 |
| 3,851,871 | 12/1974 | Aronson | 271/11 |
| 4,168,058 | 9/1979 | Granzow et al. | 271/5 |
| 4,184,670 | 1/1980 | Rosendahl | 271/12 |
| 4,268,023 | 5/1981 | Anderson | 271/106 X |
| 4,269,405 | 5/1981 | Mitzel | 271/94 |
| 4,320,893 | 3/1982 | Blümle | 271/94 |
| 4,324,394 | 4/1982 | Mitzel et al. | 271/5 |
| 4,345,752 | 8/1982 | Nakamura et al. | 271/12 |
| 4,501,416 | 2/1985 | Hain | 271/3.1 |
| 4,511,133 | 4/1985 | Kokubo et al. | 271/3.1 |

FOREIGN PATENT DOCUMENTS 938212 10/1963 United Kingdom .

*Primary Examiner*—Richard A. Schacher

*Attorney, Agent, or Firm*—Wilbert Hawk, Jr.; Albert L. Sessler, Jr.

[57] ABSTRACT

Apparatus for removing currency notes one by one from a stack of notes (82) includes a rotating suction drum (16) having openings (26) formed therein, and a fixed member (88) against which an end note (82') in the stack is urged. The fixed member (88) includes a curved portion (94) disposed adjacent to, and extending partially around the drum (16), the curved portion (94) being provided with a plurality of parallel slots (96) which are respectively disposed in cooperative relationship with the openings (26) in the drum (16). During rotation of the drum (16), vacuum is applied to the end note (82') so as to draw the lower part of this note into engagement with the curved portion (94), with the end of the note projecting slightly beyond the end of the curved portion (94). Feed rolls (38) are then moved into engagement with the end of the note, the rolls (38) and drum (16) thereafter drawing the end note away from the remainder of the stack.

9 Claims, 6 Drawing Sheets

SHEET SEPARATING APPARATUS

BACKGROUND OF THE INVENTION

This invention relates to a sheet separating apparatus for removing sheets one by one from a stack of sheets.

The invention has application, for example, to a currency note picking mechanism for extracting notes from a currency cassette used in an automated teller machine (ATM). As is well known, in operation of an ATM a user inserts a customer identifying card into the machine and then enters certain data (such as codes, quantity of currency required or to be paid in, type of transaction, etc.) upon one or more keyboards associated with the machine. The machine will then process the transaction, update the user's account to reflect the current transaction, dispense cash, when requested, extracted from one or more currency cassettes mounted in the machine, and return the card to the user as part of a routine operation.

One known kind of sheet separating apparatus is represented by a currency note picking mechanism which incorporates pivotably mounted vacuum operated suckers disposed adjacent an associated currency cassette. The suckers are arranged to draw part of an end note of a stack of notes out of the cassette and into a position where this note is engaged by cooperating drive rollers. This known apparatus has the disadvantages that the suckers tend to wear and harden with age and that the apparatus may not operate reliably with torn notes.

Other known kinds of sheet separating apparatuses incorporate a rotating suction drum arranged to engage the end sheet of a stack and to draw this sheet away from the stack as the drum rotates. Problems have been experienced with known apparatuses of this kind in that there is a tendency for double feeding of notes from a stack to take place, particularly if the sheets have tears therein, unless special precautions are taken.

SUMMARY OF THE INVENTION

The present invention provides a sheet separating apparatus for removing sheets one by one from a stack, which apparatus is of simple construction and which alleviates the disadvantages and problems referred to above experienced with known sheet separating apparatuses.

In accordance with one embodiment of the invention, sheet separating apparatus for removing sheets one by one from a stack of sheets comprises a suction drum having first aperture means formed in its periphery, sheet engaging means against which an end sheet in said stack is urged in operation, said sheet engaging means including a curved portion which is disposed adjacent to, and extends partially around, the periphery of said suction drum, and which has second aperture means formed therein, means for applying vacuum to said suction drum whereby vacuum is applied in operation to said end sheet via said first aperture means and said second aperture means so as to cause part of said end sheet to be drawn away from said stack and into engagement with said curved portion, with an end portion of said end sheet projecting beyond said sheet engaging means, and rotating feed means arranged to engage said end portion of said end sheet, following movement of said part of said end sheet into engagement with said curved portion, so as to cause said end sheet to be gripped between said suction drum and said feed means and thereby to be pulled away from said stack.

It should be understood that, since the suction drum of an apparatus in accordance with the present invention only makes contact with an end portion of an end note of a stack after this portion has been drawn away from the stack, there is no tendency for the next note in the stack to be drawn away along with said end note.

It is accordingly an object of the present invention to provide sheet separating apparatus for removing sheets one by one from a stack, which apparatus is of simple construction and which alleviates the disadvantages and problems referred to above experienced with known sheet separating apparatuses.

With this and other objects, which will become apparent from the following description, in view, the invention includes certain novel features of construction and combinations of parts, a preferred form or embodiment of which is hereinafter described with reference to the drawings which accompany and form a part of this specification.

DESCRIPTION OF THE PREFERRED EMBODIMENT

Figure 1:
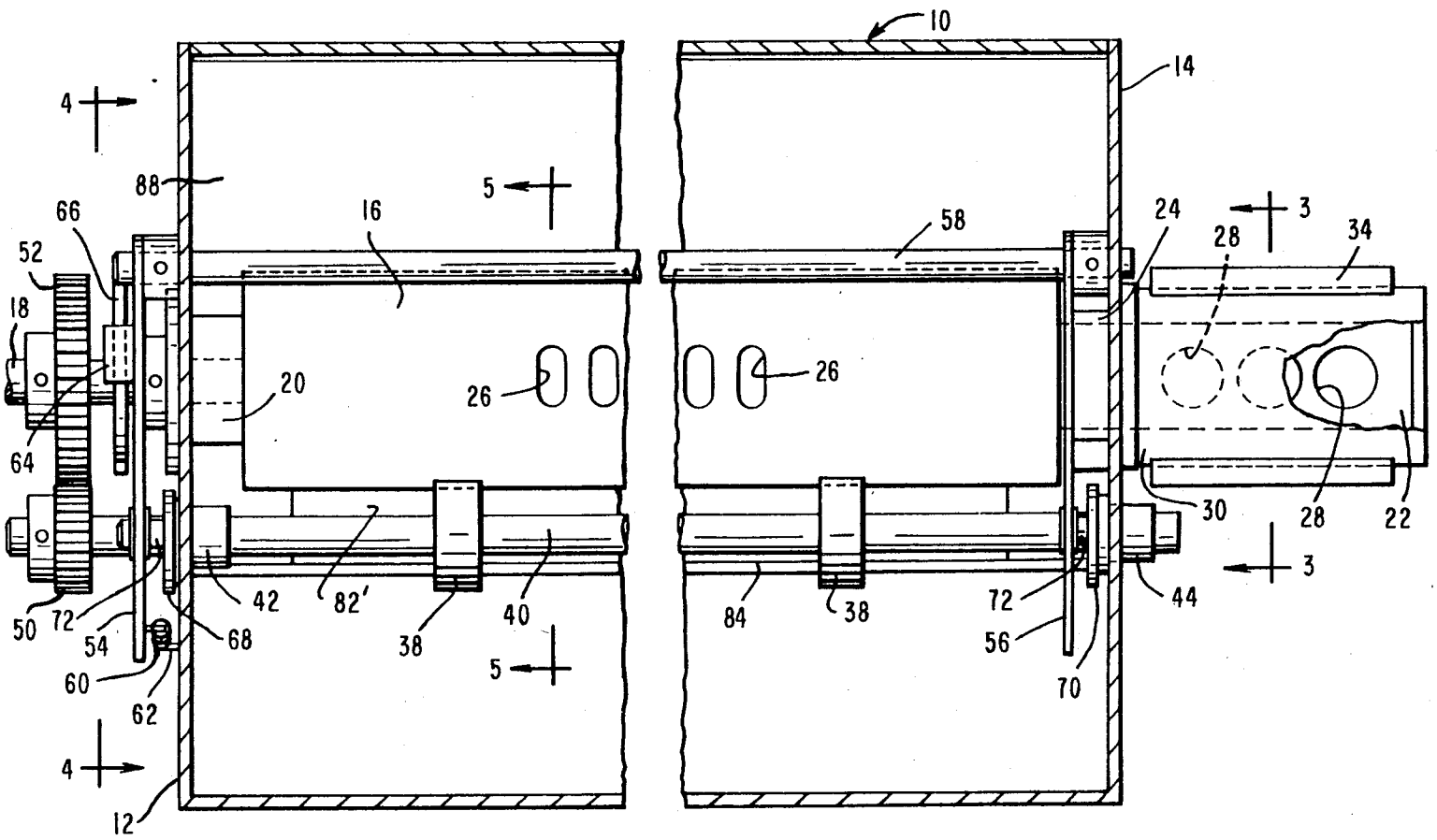
FIG. 1 is a part sectional, end elevational view, shown partly broken away, of a currency note separating apparatus.

Referring first to FIGS. 1 to 4 and 5A to 5E of the drawings, the currency note separating apparatus shown therein includes a supporting framework 10 having parallel side walls 12 and 14. A suction drum 16 in the form of a hollow steel cylinder is rotatably mounted between the side walls 12 and 14. The left hand end (with reference to FIG. 1) of the drum 16 is closed and is supported by means of an axially extending rotatable drive shaft 18, the shaft 18 extending through the side wall 12 and through bearing means 20 secured to the wall 12, and being continuously driven in operation by an electric motor (not shown). The other end of the drum 16 opens into, and is supported by, an axially extending tubular member 22. An air-tight joint is formed between the drum 16 and the tubular member 22, and the end of the tubular member 22 remote from the drum 16 is closed. The tubular member 22 extends through the side wall 14 and is rotatably supported by bearing means 24 secured to the wall 14. The drum 16 has formed in its periphery a plurality of similar, elongated openings 26 each extending partly around the periphery of the drum 16, the openings 26 being arranged in a row extending parallel to the axis of the drum 16, with the openings 26 being spaced apart at equal intervals along the row.

Figure 3:
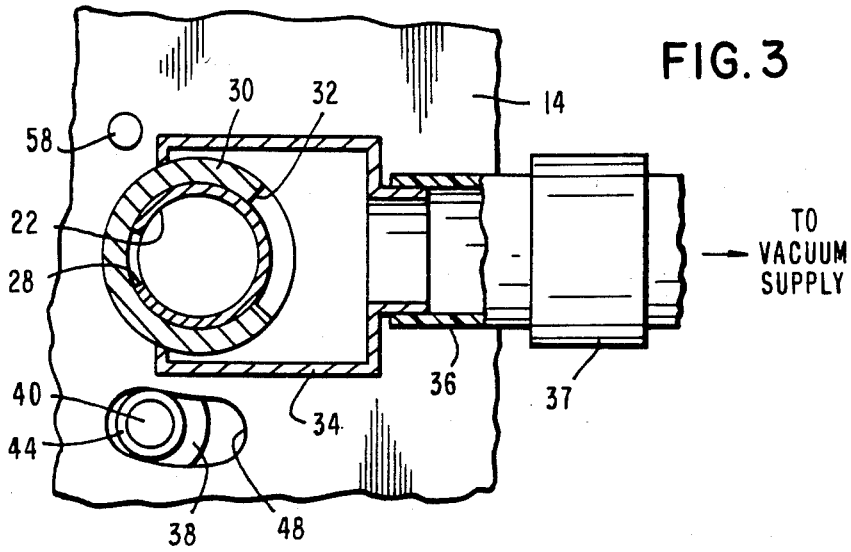
FIG. 3 is a sectional, side elevational view of part of the apparatus of FIG. 1 taken along the line 3—3 of FIG. 1.

Three circular openings 28 are formed in the periphery of that part of the tubular member 22 extending beyond the side wall 14. As seen in FIG. 1 and FIGS. 5A to 5E, the openings 28 are so disposed that at any instant they face in the same direction as the openings 26, with their centers lying in the same plane as the centers of the openings 26. The part of the tubular member 22 in which the openings 28 are formed is a rotatable fit inside a fixed sleeve 30 (shown partly broken away in FIG. 1), one end of which is secured to the side wall 14. In the wall of the sleeve 30 there are formed three elongated openings 32 (see FIG. 3) which are respectively associated with the openings 28 in the tubular member 22, each opening 32 having a width slightly less than the diameter of the associated opening 28 and an angular extension somewhat greater than said diameter. The centers of the openings 32 lie in a plane parallel to the axis of the sleeve 30, and the disposition of the openings 32 is such that at one point in each revolution of the assembly of the drum 16 and tubular member 22 the centers of the openings 32 become respectively aligned in communicating relationship with the centers of the openings 28. Referring particularly to FIG. 3, the openings 32 are surrounded by a hollow connector member 34 which is sealed to the outer surface of the sleeve 30 so as to provide an air-tight joint therewith. The connector member 34 is connectable via a flexible tube 36 and control means 37 to a vacuum supply (not shown). When the connector member 34 is connected to the vacuum supply, the vacuum is applied to the interior of the suction drum 16, via the tubular member 22, when the openings 28 in the tubular member 22 come into communicating relationship with the openings 32 in the sleeve 30.

A pair of feed rolls 38 of elastomeric material are positioned so as to be in continuous cooperative engagement with the periphery of the suction drum 16, the rolls 38 being mounted on a shaft 40 which extends between, and passes through, the side walls 12 and 14. The shaft 40 is supported by bushes 42 and 44 which respectively slidably engage in two curved slots 46 and 48 formed in the side walls 12 and 14. As will be explained later, the bushes 42 and 44 are movable along the slots 46 and 48 so as to change the angular position of the rolls 38 relative to the axis of the drum 16. The disposition of the slots 46 and 48 is such that the rolls 38 are held in cooperative engagement with the drum 16 regardless of the position of the bushes 42 and 44 in the slots 46 and 48. The shaft 40 is driven by a gear 50 secured to that part of the shaft 40 projecting beyond the side wall 12, the gear 50 engaging with a gear 52 secured to that part of the drive shaft 18 projecting beyond the side wall 12. The arrangement of the gears 50 and 52 is such that the rolls 38 rotate in synchronism with the drum 16 without any slippage occurring between the peripheries of the rolls 38 and drum 16.

Figure 4:
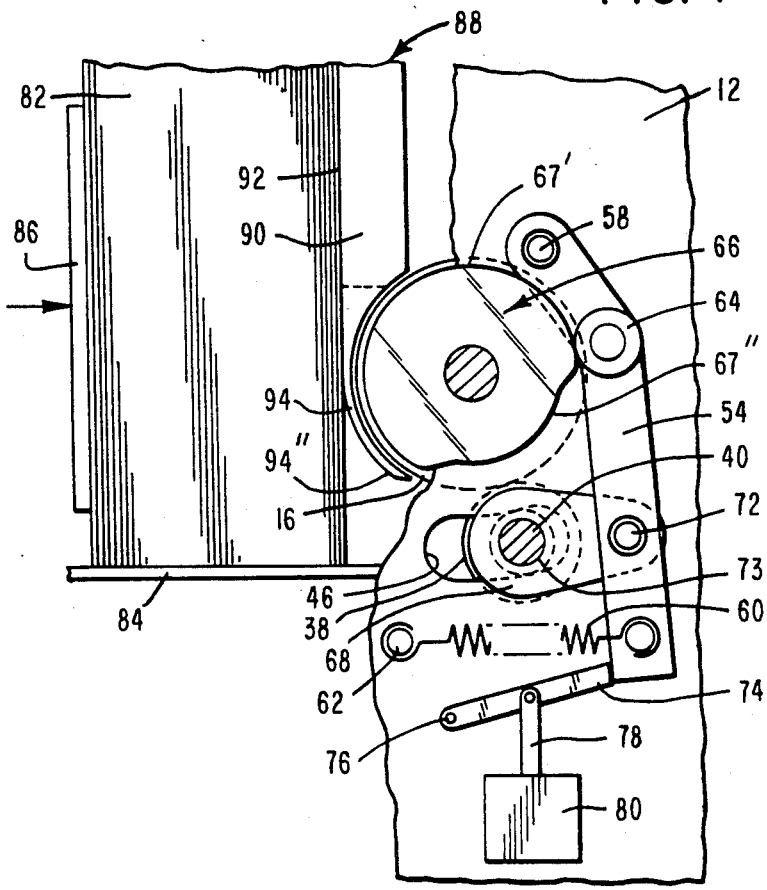
FIG. 4 is a sectional, side elevational view taken along the line 4—4 of FIG. 1, with part of the adjacent side plate being shown broken away.

Corresponding ends of a pair of arms 54 and 56 are secured to a rotatable support shaft 58 which passes through, and is supported by, the side walls 12 and 14, the arm 54 being disposed adjacent the outer surface of the side wall 12, and the arm 56 being disposed adjacent the inner surface of the side wall 14. As best shown in FIG. 4, that end of the arm 54 remote from the rod 58 is connected by means of a tension spring 60 to a stud 62 secured to the side wall 12, whereby the arm 54 is urged to rotate in a clockwise direction (with reference to FIG. 4) about the axis of the rod 58. The arm 54 carries a follower roll 64 at a point intermediate its ends. The follower roll 64 bears against the periphery of a cam 66 which is mounted on the drive shaft 18 for rotation therewith, the cam 66 being disposed between the gear wheel 52 and the side wall 12. As shown in FIG. 4, the periphery of the cam 66 has a high portion 67' and a low portion 67''. Corresponding ends of two link members 68 and 70 are respectively pivotably connected to the two arms 54 and 56 by means of two connecting studs 72. The shaft 40 on which the feed rolls 38 are mounted passes through, and is a rotatable fit in, two circular apertures 73 respectively formed in portions of the link members 68 and 70 spaced from the connecting studs 72. As will be explained in more detail later, the link members 68 and 70 serve to bring about movement of the bushes 42 and 44 along the curved slots 46 and 48 in response to rotational movement of the arms 54 and 56 about the axis of the shaft 58. The assembly of the arms 54 and 56 and shaft 58 is normally held in the position shown in FIG. 4 (corresponding to the position in which the follower roll 64 is in engagement with the high portion 67' of the cam 66 by means of a stop arm 74 (shown only in FIG. 4), one end of the stop arm 74 engaging with that end of the arm 54 remote from the shaft 58. The opposite end of the stop arm 74 is rockable about a fixed pivot 76, and an armature 78 of a solenoid 80 (shown only in FIG. 4) is pivotally connected to an intermediate portion of the stop arm 74. The arrangement is such that energization of the solenoid 80 serves to pivot the stop arm 74 in a clockwise direction (with reference to FIG. 4) so as to move the relevant end of the stop arm 74 out of engagement with the arm 54. Upon the solenoid 80 being de-energized, the stop arm 74 is moved by spring means (not shown) back to the position shown in FIG. 4 in which the stop arm 74 again engages with the arm 54.

Figure 2:
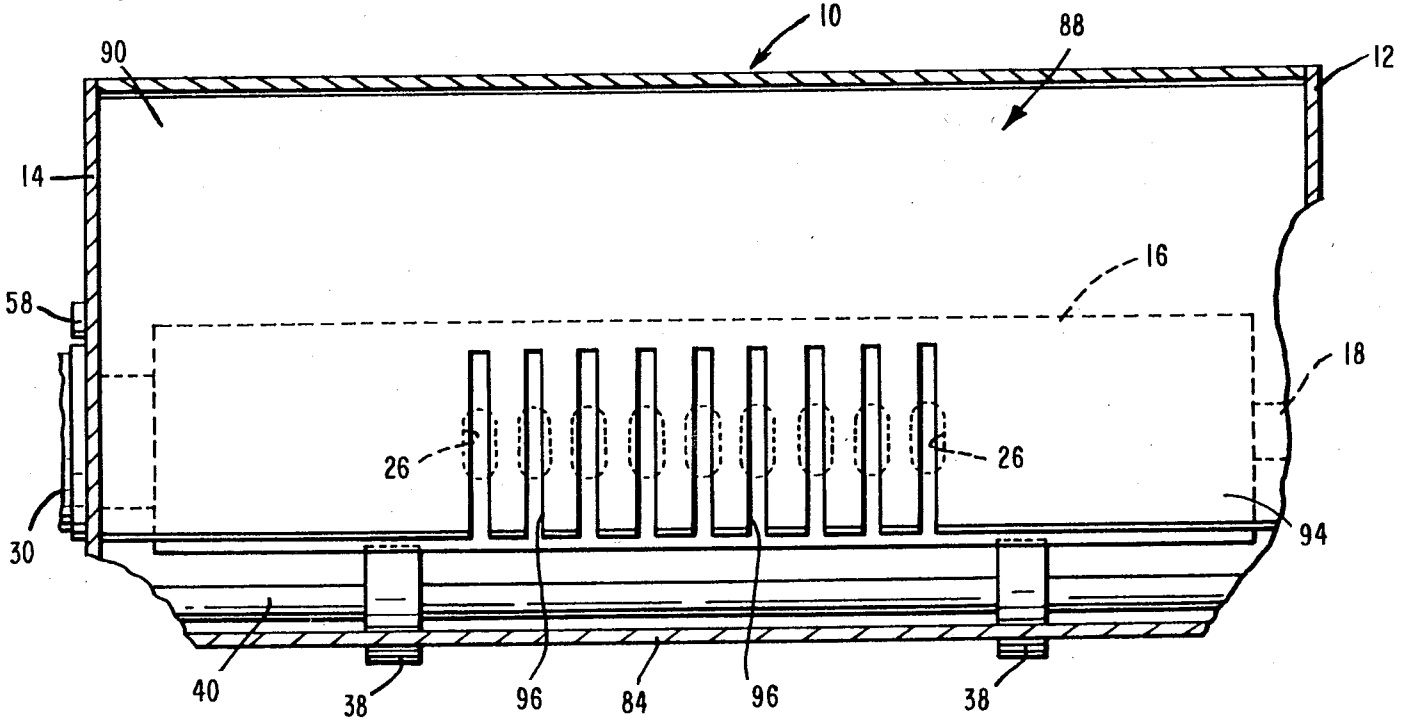
FIG. 2 is a part sectional, end elevational view of part of the apparatus of FIG. 1, this view being taken from the opposite end of the apparatus compared with FIG. 1.

In operation, a stack of currency notes 82 (not shown in FIG. 2) is supported on a horizontal base plate 84 which, extends between, and is secured to, the side walls 12 and 14, with corresponding long edges of the notes 82 resting on the base plate 84. If desired, adjustably positioned side guide members (not shown) may be provided for engaging the short edges of the stack of notes 82. A spring loaded pusher plate 86 is arranged to urge the stack of notes 82 against a note engaging member or guide comb 88. The guide comb 88 extends between, and is secured to, the side walls 12 and 14, and includes an upper portion 90 having a planar, vertically extending surface 92 which engages the leading note 82' in the stack. The guide comb 88 also includes a lower curved portion 94, integral with the upper portion 90, which is disposed adjacent to, and extends partially around, the periphery of the suction drum 16. The lower edge of the curved portion 94 is tapered and is spaced from the base plate 84 and from the feed rolls 38. As seen in FIG. 2, the curved portion 94 is in the form of a comb-like structure, a plurality of parallel slots 96, corresponding in number and position with the openings 26 in the suction drum 16, extending upwardly from the lower edge of the curve portion 94. The slots 96 are so positioned that during part of each revolution of the suction drum 16 the openings 26 are respectively in communicating relationship with the slots 96, whereby vacuum is applied in operation to the leading note 82' via the openings 26 and the slots 96.

Figure 5C:
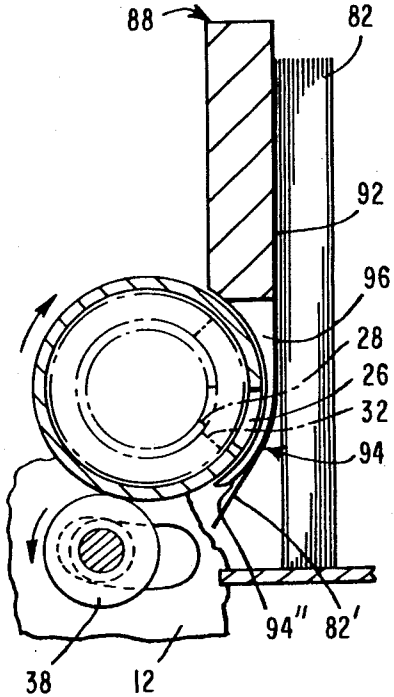
FIGS. 5A to 5E are schematic sectional, side elevational views, taken along the line 5—5 in FIG. 1, showing different stages in a cycle of operation of the apparatus.
Figure 5B:
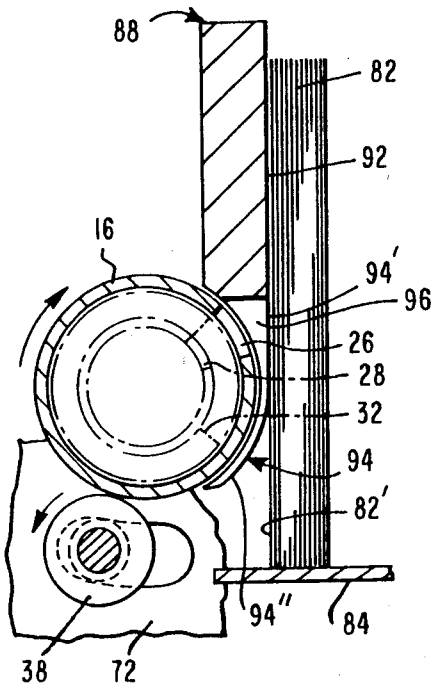
Figure 5A:
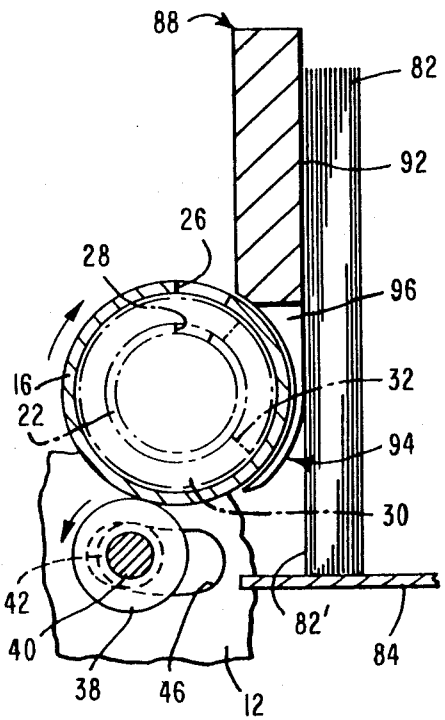

The operation of the note separating apparatus will now be described with particular reference to FIGS. 5A to 5E. The suction drum 16 and the feed rolls 38 continuously rotate in operation in the directions indicated by the arrows in FIGS. 5A to 5E. As previously mentioned, the assembly of the arms 54 and 56 and the shaft 58 is normally held in the position shown in FIG. 4 by virtue of the stop arm 74 engaging with that end of the arm 54 remote from the shaft 58. With said assembly in this position, the feed rolls 38 are in their leftmost positions (with reference to FIGS. 5A to 5E), as shown, for example, in FIG. 5A. Also, normally the control means 37 (FIG. 3) serves to disconnect the suction drum 16 from the vacuum supply. In the absence of vacuum applied to the suction drum 16, the lower edge of the leading note 82' rests on the base plate 84 as shown in FIG. 5A, the upper portion of the note 82' being urged against the planar surface 92 of the guide comb 88. When it is desired to separate the leading note 82' from the stack of notes 82 and feed the note 82' from the apparatus, the solenoid 80 (FIG. 4) is energized so as to disengage the stop arm 74 from the arm 54, and the control means 37 is operated so as to connect the connector member 34 (FIG. 3) to the vacuum supply.

The solenoid 80 is energized when the follower roll 64 is in engagement with the high portion 67' of the cam 66, and the control means 37 is operated to apply vacuum to the connector member 34 when the openings 28 in the tubular member 22 are out of communication with the openings 32 in the sleeve 30. Thus, at the commencement of a note separating operation, no vacuum is applied to the leading note 82' and the feed rolls 38 are retained in their leftmost positions (with reference to FIGS. 5A to 5E). FIG. 5A illustrates this initial situation. As the assembly of the suction drum 16 and tubular member 22 continues to rotate, the position shown in FIG. 5B is reached in which the openings 28 in the tubular member 22 have come into communicating relationship with the openings 32 in the sleeve 30, and the openings 26 in the suction drum 16 have come into communicating relationship with the slots 96 in the guide comb 88. Accordingly, vacuum is now applied to the leading note 82' via the connector member 34, the openings 28 and 32, the tubular member 22, and the openings 26 and slots 96. However, at this stage the openings 26 in the suction drum 16 are communicating with a part of the curved portion 94 having a planar, vertical outer surface 94' so that no movement of the leading note 82' takes place. Also, at this stage the follower roll 64 remains in engagement with the high portion 67' of the cam 66 so that no spatial movement of the feed rolls 38 takes place.

Figure 5E:
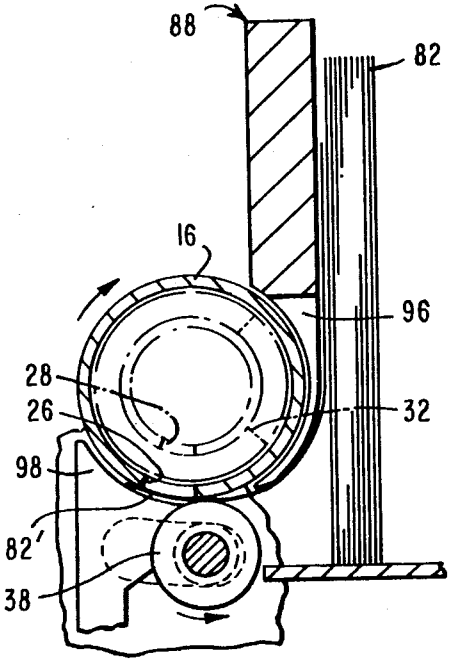
Figure 5D:
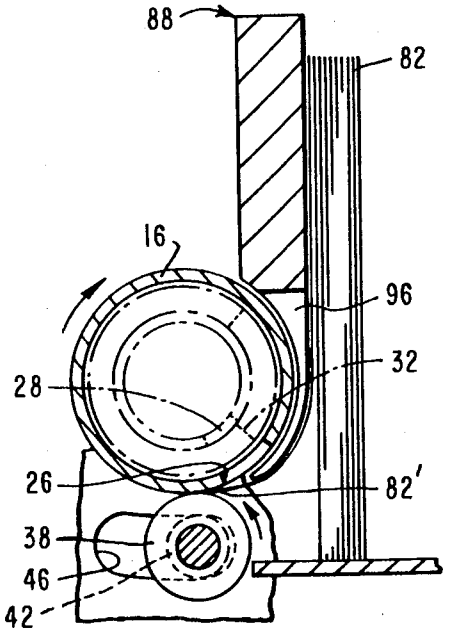

Next, the openings 26 in the suction drum 16 come into communicating relationship with a lower part of the curved portion 94, which part has a curved outer surface 94''. At this stage, which is illustrated in FIG. 5C, the openings 28 in the tubular member 22 are still in communicating relationship with the openings 32 in the sleeve 30 so that vacuum continues to be applied to the leading note 82', this applied vacuum causing the lower part of the note 82' to be bent away from the stack 82 and into engagement with the curved outer surface 94'' of the guide comb 88. It should be understood that since at this stage the leading note 82' is held out of engagement with the suction drum 16 by means of the guide comb 88 there is no relative sliding movement between the leading note 82' and the second note in the stack 82 and no tendency for this second note to be separated from the stack 82. Also, it should be noted that at this stage the feed rolls 38 remain held in their leftmost positions by virtue of the follower roll 64 remaining in engagement with the high portion 67' of the cam 66, so that the rolls 38 are held out of engagement with the lower edge of the note 82' and therefore do not interfere with this note as its lower portion moves into engagement with the curved surface 94''. As seen in FIG. 5C, the lower edge of the leading note 82' projects a short distance beyond the lower edge of the curved portion 94 of the guide comb 88. As the openings 26 start to move beyond the lower edge of the lower portion 94 of the guide comb 88 during continued rotation of the suction drum 16, the lower edge of the note 82' is sucked into actual engagement with the periphery of the drum 16 since the openings 28 in the tubular member 22 are still in communicating relationship with the openings 32 in the sleeve 30. Immediately thereafter, the follower roll 64 moves into engagement with the low portion 67'' of the cam 66 under the action of the spring 60 (FIG. 4). This movement causes the link members 68 and 70 to bring about a movement of the bushes 42 and 44 along the curved slots 46 and 48 so as to move the feed rolls 38 into their rightmost positions (with reference to FIGS. 5A to 5E). While the feed rolls 38 are being moved in this manner they remain in cooperative engagement with the periphery of the suction drum 16, and at the completion of this movement the lower edge of the leading note 82' is gripped between the feed rolls 38 and the drum 16. This is the position shown in FIG. 5D. During the final stage of the note separating operation, the leading note 82' is fed by the feed rolls 38 and the drum 16 away from the stack 82 as shown in FIG. 5E. Immediately after the note 82' commences to be fed from the stack 82, the openings 28 move out of communicating relationship with the openings 32 so that vacuum ceases to be applied to the note 82', thereby enabling the note 82' to be readily removed from engagement with the drum 16 following the completion of the separation of the note 82' from the stack 82. Guide means 98 (shown only in FIG. 5E) are provided in cooperative relationship with the drum 16 for guiding the note 82' during feeding movement thereof away from the stack 82.

It is found that the currency note separating apparatus described above operates reliably with torn notes, since during a note separating operation vacuum is applied to the leading note 82' of the stack over a wide area. Moreover, there is no tendency for double notes to be extracted in operation from the stack 82; accordingly, the apparatus is enabled to be of simple construction since no special means are required for preventing the extraction of double notes.

Figure 6:
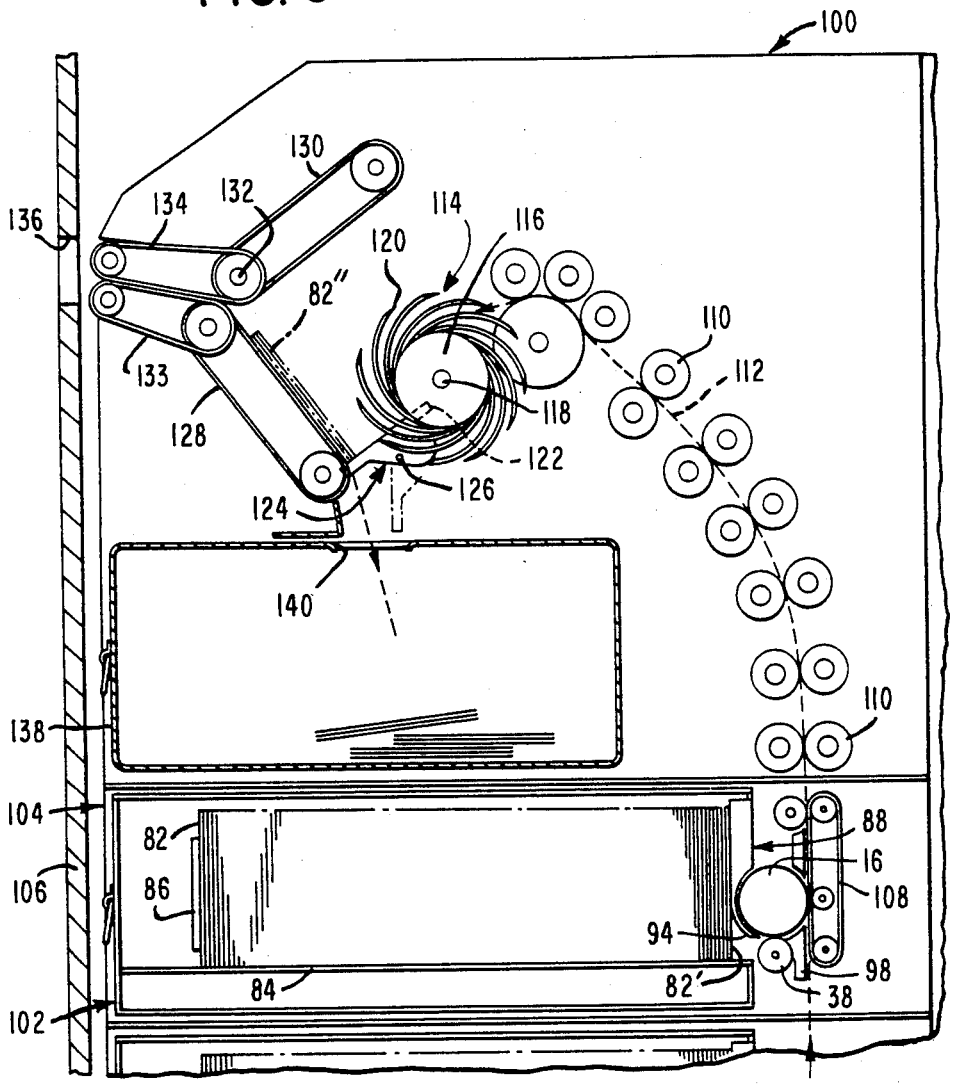
FIG. 6 is a schematic part sectional, side elevational view of a cash dispenser unit of an ATM incorporating a currency note separating apparatus similar to the apparatus of the previous FIGS.

Referring now to FIG. 6, the currency note separating apparatus described above with reference to FIGS. 1 to 4 and 5A to 5E can be readily modified for use in a cash dispenser unit 100 of an ATM. Components used in the cash dispenser unit 100 of FIG. 6 which are similar to components used in the note separating apparatus described above have the same reference numerals as the similar components shown in FIGS. 1 to 4 and 5A to 5E. The dispenser unit 100 includes a plurality of currency cassettes 102 arranged in a stacked relationship, each cassette 102 being removably mounted in a respective compartment 104 of a housing 106. Each cassette 102 includes a base plate 84, guide comb 88, and pusher plate 86 of a currency note separating apparatus such as has been previously described. A stack of currency notes 82 is held in each cassette 102, the stack 82 being urged by the pusher plate 86 of the cassette 102 against the guide comb 88. As in the case of the separating apparatus previously described, the guide comb 88 of each cassette 102 includes a slotted curved portion 94 which is disposed adjacent to, and extends partially around, a suction drum 16 which is arranged in cooperative relationship with a pair of feed rolls 38 and guide means 98. The guide comb 88 of each cassette 102 forms part of the wall of the cassette 102, whereas the axis of the associated suction drum 16 is fixed relative to the housing 106; it should be understood that when the cassette 102 is fully inserted in the respective compartment 104 the guide comb 88 is in the correct operational relationship with respect to the drum 16.

When one or more currency notes are to be dispensed from a particular cassette 102 in the course of a cash withdrawal operation, the associated suction drum 16 and feed rolls 38 are actuated, in the manner previously described, to separate the leading note 82' in the cassette 102 from the stack 82 and feed this note 82' to a position where its leading edge is gripped between a feed belt 108 and the periphery of the drum 16. The note 82' is then fed by the feed belt 108 and by a series of feed rolls 110 along a feed path 112 to a conventional stacking wheel 114 which is arranged to continuously rotate in operation in an anticlockwise direction. Means (not shown) are provided along the feed path 112 for detecting any multiple feeding of notes and for detecting any invalid or torn note. The stacking wheel 114 comprises a plurality of stacking plates 116 spaced apart in parallel relationship along the stacker wheel shaft 118, each stacking plate 116 incorporating a series of curved tines 120. The tines 120 of the stacking plates 116 pass between fingers 122 of a stripper plate assembly 124 rockably mounted on a shaft 126. In operation, each note fed along the feed path 112 by the feed rolls 110 enters between adjacent tines 120 of the stacking plates 116 and is carried partly around the axis of the stacking wheel 114, the note being stripped from the wheel 114 by the fingers 122 and being stacked against a belt 128 with a long edge of the note resting on the stripper plate assembly 124. The belt 128 cooperates with a pair of belts 130 (only one of which is shown) which are rockably mounted on a shaft 132 and which are normally held in the position shown in FIG. 6. When a bundle of notes 82" (or possibly a single note only) to be dispensed to a user in response to a cash withdrawal request has been stacked against the belt 128, the belts 130 are rocked in a clockwise direction so as to trap the bundle of notes 82" between the belt 128 and the belts 130. It should be understood that in the course of this rocking movement the belts pass between adjacent pairs of the stacking plates 116. Assuming that none of the notes in the bundle 82" have been rejected for any reason, the belts 128 and 130 are operated so as to drive the bundle 82" to a pair of drive belts 133 and 134. The belts 133 and 134 serve to drive the bundle 82" through a note exit slot 136 in the housing 106 to a position where the bundle can be collected by the user of the ATM. It should be understood that the belts 128 and 130 are mounted in resilient relationship relative to each other and the belts 133 and 134 are also mounted in resilient relationship relative to each other, so that bundles of notes of varying thickness can be held between, and fed by, the belts 128 and 130 and the belts 133 and 134. If a multiple feeding has been detected in the course of stacking the bundled of notes 82" against the belt 128, or if one or more of the notes in the bundle 82" have been rejected for any other reason, then the stripper plate assembly 124 is rocked into the position shown in dashed outline in FIG. 6 and the belts 128 and 130 are operated to feed the bundle 82" in a direction opposite to the normal feed direction, the bundle 82" being deposited in a reject note container 138 via an opening 140 in the top thereof.

What is claimed is:

1. Sheet separating apparatus for removing sheets one by one from a stack of sheets supported on a base plate, comprising:

a continuously rotatable suction drum having first aperture means formed in its periphery;

sheet engaging means against which an end sheet in said stack is urged in operation, said sheet engaging means including a curved portion which is disposed adjacent to, and extends partially around, the periphery of said suction drum, the end of said curved portion being spaced from said base plate to permit movement of a portion of the end sheet which is adjacent to said base plate, and which sheet engaging means has second aperture means formed therein;

means for applying vacuum to said suction drum whereby vacuum is applied in operation to said end sheet via said first aperture means and said second aperture means so as to cause said adjacent portion of said end sheet to be drawn away from said stack and into engagement with said curved portion, whith an end portion of said end sheet projecting beyond the end of said sheet engaging means into engagement with the drum to be moved thereby; and rotating feed means arranged to engage said end portion end sheet, following movement of said adjacent portion of said end sheet into engagement with said curved portion, so as to cause said end sheet to be gripped between said suction drum and said feed means and thereby to be pulled away from said stack.

2. The sheet separating apparatus of claim 1, also including means for controlling the application of vacuum to said end sheet via said first aperture means so that vacuum ceases to be applied to said end sheet subsequent to said end portion being engaged by said feed means.

3. The sheet separating apparatus of claim 1, wherein said second aperture means are in the form of a plurality of parallel slots extending partially around the periphery of said suction drum, and wherein said first aperture means are in the form of a row of openings which are so disposed as to come into respective communicating relationship with said slots during rotation of said suction drum.

4. The sheet separating apparatus of claim 3, wherein said openings are elongated and extend partially around the periphery of said suction drum.

5. The sheet separating apparatus of claim 3, wherein said curved portion is in the form of a comb-like structure.

6. The sheet separating apparatus of claim 1, wherein said feed means are in the form of roll means in continuous cooperative engagement with the periphery of said suction drum, and movable between first and second position during a revolution of said suction drum, said first position being further from said curved portion than is said second position, said apparatus including control means arranged to maintain said roll means in said first position during a predetermined part of each revolution of said suction drum during which said end sheet is movable into engagement with said curved portion.

7. The sheet separating apparatus of claim 6, including selectively operable means operatively associated with said control means and arranged to prevent said roll means from moving to said second position during a revolution of said suction drum, or to permit said roll means to move to said second position during a revolution of said suction drum, depending on whether said selectively operable means is in a first state or a second state.

8. The sheet separating apparatus of claim 1, wherein said suction drum is connected to a tubular member, coaxial with said suction drum, via which vacuum is applied to said suction drum, said tubular member being arranged to rotate within a fixed sleeve the periphery of which is provided with third aperture means connectable to a source of vacuum, the periphery of said tubular member being provided with fourth aperture means so disposed as to come into communicating relationship with said third aperture means during part of each revolution of said suction drum, whereby the timing and duration of the application of vacuum to said suction drum is controlled when said third aperture means are connected to said source of vacuum.

9. The sheet separating apparatus of claim 1, also including sheet transport means arranged to receive said end sheet fed thereto by said suction drum and said feed means.

* * * * *

UNITED STATES PATENT AND TRADEMARK OFFICE

CERTIFICATE OF CORRECTION

PATENT NO. : 4,739,982

DATED : April 26, 1988

INVENTOR(S) : David A. Hain

It is certified that error appears in the above—identified patent and that said Letters Patent is hereby corrected as shown below:

Column 8, line 31, delete "whith" and substitute --with--.

Column 8, line 36, after "tion" insert --of said--.

Column 8, line 66, delete "position" and substitute --positions--.

Signed and Sealed this

First Day of November, 1988

*Attest:*

*Attesting Officer*

DONALD J. QUIGG

*Commissioner of Patents and Trademarks*